US006817351B2

(12) United States Patent
Keller et al.

(10) Patent No.: US 6,817,351 B2
(45) Date of Patent: Nov. 16, 2004

(54) BALL LAUNCHING DEVICE

(75) Inventors: Michael Keller, Tallmadge, OH (US); G. Stewart Lenox, Wadsworth, OH (US); Craig L. Markin, Copley, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 10/396,968

(22) Filed: Mar. 24, 2003

(65) Prior Publication Data

US 2004/0020481 A1 Feb. 5, 2004

Related U.S. Application Data

(60) Provisional application No. 60/401,126, filed on Aug. 5, 2002, and provisional application No. 60/416,050, filed on Oct. 4, 2002.

(51) Int. Cl.[7] ..... F41B 3/04

(52) U.S. Cl. ..... 124/6; 273/119 R; 273/447; 446/242

(58) Field of Search ..... 273/129 V, 129 R, 273/119 R, 447; 124/4, 6; 473/571; 446/236, 242, 265

(56) References Cited

U.S. PATENT DOCUMENTS

| | | | | | |
|---|---|---|---|---|---|
| 4,000,899 | A | * | 1/1977 | Breslow | 273/386 |
| 4,147,352 | A | * | 4/1979 | Rosero | 273/138.4 |
| 5,632,490 | A | * | 5/1997 | Brown | 273/350 |
| 5,927,262 | A | * | 7/1999 | Bixler | 124/81 |

* cited by examiner

*Primary Examiner*—Jacob K. Ackun
(74) *Attorney, Agent, or Firm*—Renner, Otto, Boisselle & Sklar, LLP

(57) ABSTRACT

A ball launching device for children that has an outer housing, an inner bowl and a launch assembly. The inner bowl has an inner surface with an outwardly curved cone shaped wall and a vertical linear wall. The launch assembly is connected to the bowl. When the bowl rotates at high speeds, the curved cone shaped wall enables balls to ascend up the inner surface and eventually propel out of the ball launching device.

26 Claims, 3 Drawing Sheets

BALL LAUNCHING DEVICE

CROSS REFERENCE TO RELATED APPLICATIONS

This application claims priority to U.S. Provisional Patent Application Ser. No. 60/401,126 filed on Aug. 5, 2002 and U.S. Provisional Patent Application Ser. No. 60/416,050 filed on Oct. 4, 2002.

FIELD OF THE INVENTION

This invention relates generally to a children's toy, and, more particularly to, a ball launching and collection activity device.

BACKGROUND OF THE INVENTION

Various amusement devices that allow children to collect balls or to collect and reinsert balls into a device are known in the art. For example, it is known to provide a ball collection game where balls are blown upward from an apparatus and collected by a basket or other hand held device. Since the balls are air blown, they are typically small and light in weight. The user typically stands next to the apparatus so that he may collect the balls with the hand held device as they are blown from the bottom of the apparatus. If a ball is not collected, it will drop back into the apparatus. The apparatus continues to blow the balls until the user collects all of the balls.

It is also known to provide a ball collection game where the user attempts to shoot balls into a cylindrical opening. Once the ball is correctly inserted through the opening, it travels through the device and is released at the bottom of the device so that the user may continuously shoot the ball towards the opening.

Additionally, it is known to launch balls from a machine in an athletic environment. Athletic ball launching machines are used to assist the development of motor skills, such as hand—eye coordination, as well as to practice various athletic skills. For example, a tennis ball launching machine duplicates various shots, such as a lob or a line drive wherein the user practices his shot by returning the various shots towards the tennis ball launching machine. A baseball launching machine duplicates line drives, pop ups and grounders wherein the user may practice fielding the baseballs from the baseball launching machine. Thus, both the tennis ball launcher and the baseball launcher simulate various environments that enable the user to develop various athletic skills.

Athletic ball launching machines, however, typically include a flywheel mechanism that is used to launch a ball out of the apparatus. Often, the timing of the launching mechanism is offset and the balls become jammed within the flywheel launching mechanism potentially causing the mechanism to malfunction.

Additionally, the prior art ball launching apparatuses do not provide children with the opportunity to collect balls that are randomly launched away from the top of the apparatus and to insert the collected balls back into the apparatus.

Thus, it is desirable to create an improved ball collection and launching apparatus that enables children to develop motor skills as well as burn energy.

Accordingly, it is an object of the invention to provide a ball collection and launching apparatus that shoots balls out of the top of the device in various directions and at various speeds.

It is another object of the invention to provide a ball collection and launching apparatus that may be used simultaneously by a number of children.

It is yet another object of the invention to provide a ball launching device with minimal parts thereby reducing the manufacturing costs of the product.

These and other objects of the present invention, as well as the advantages thereof over existing prior art forms, which will become apparent from the description to follow, are accomplished by the improvements herein after described and claimed.

SUMMARY OF THE INVENTION

The present invention is directed to a ball launching device having an outer housing, a bowl and a launch assembly. The bowl and launch assembly are disposed in the outer housing. The bowl has a cone shaped wall and a vertical linear wall. The launch assembly is coupled to the bowl. The launch assembly includes a pulley energized by a motor that rotates the bowl. When the bowl rotates at a high speed, the cone shaped wall enables balls in the bowl to ascend up an inner surface of the bowl and propel out of the device.

The following detailed description of embodiments of the invention, taken in conjunction with the appended claims and accompanying drawings, provide a more complete understanding of the nature and scope of the invention.

DETAILED DESCRIPTION

Figure 1:
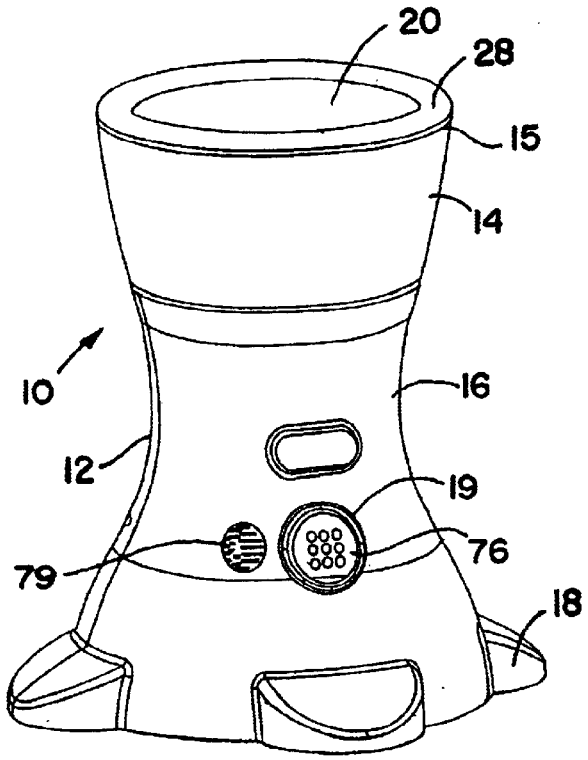
FIG. 1 is a perspective view of the ball launching device of the present invention.

FIG. 1 illustrates the ball launching device, indicated in general at 10, of the present invention. The ball launching device includes an outer housing 12 having a top portion 14, a bottom portion 16 and a plurality of feet 18 that extend outwardly from the bottom portion 16. The top portion 14 and the bottom portion 16 of the outer housing 12 form a generally cylindrical shape with the top portion 14 of the outer housing having a slight curve that extends outwardly and upwardly from the bottom portion. The feet 18 are preferably spaced an equal distance from each other around the generally cylindrical shaped bottom portion 16. The feet 18 provide support for the ball launching device and enable the ball launching device to be placed flat on various surfaces, such as grass, cement or asphalt.

Figure 4:
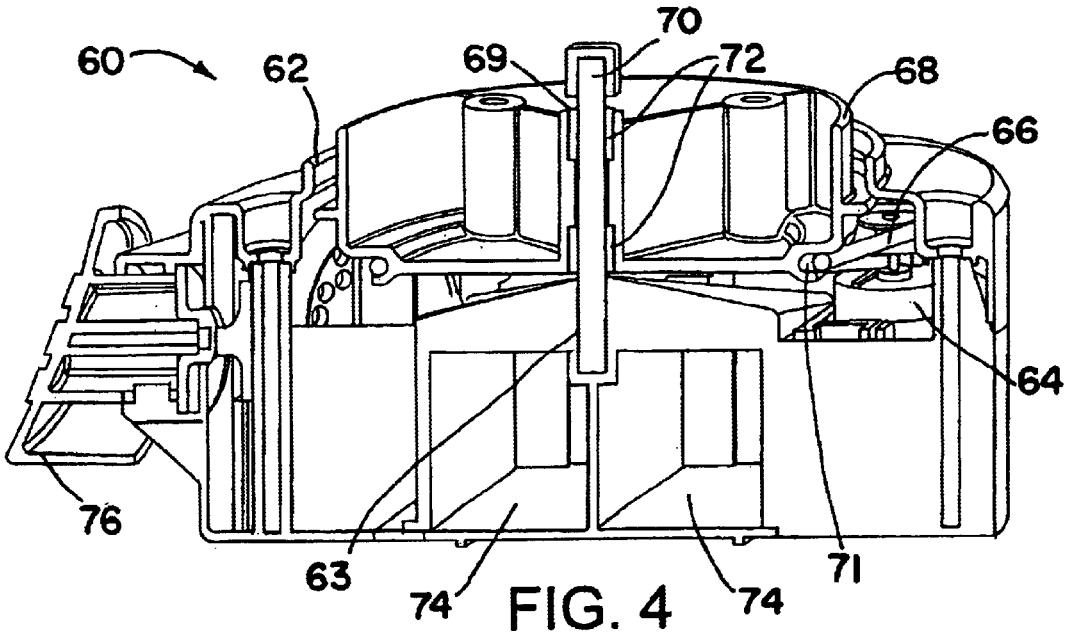
FIG. 4 is detailed cross sectional view of the launch assembly of the ball launching device illustrated in FIG. 2.

Also shown in FIG. 1, the bottom portion 16 of the outer housing 12 includes an opening 19 for receiving the on/off button 76 that activates the launch assembly 60 (see FIG. 4).

Figure 2:
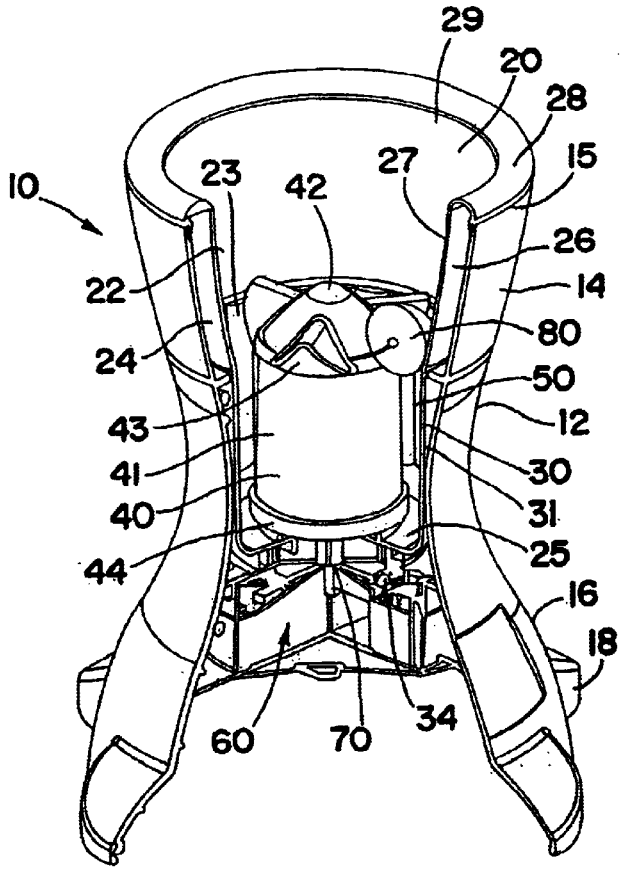
FIG. 2 is a sectional view of the ball launching device of FIG. 1.

As shown in FIG. 2, the ball launching device 10 of the present invention also includes a bowl 20 and a launch assembly 60 that are disposed within the outer housing 12 of the device. The bowl 20 includes an inner surface 22, an outer surface 24 and a bottom surface 25. The bottom half 30 of the bowl 20 has a generally vertical linear wall 31 that has a scalloped lining 23 (see FIG. 3). The vertical linear wall 31 leads to a cone shaped wall 27 that forms the top half 26 of the bowl 20. The cone shaped wall 27 curves upwardly and outwardly from the vertical linear wall 31 resulting in an open upper end 29. The cone shaped wall 27 of the bowl 20 follows the curve of the outer housing 12. The bowl 20 also includes a curved lip 28 that extends downwardly from the cone shaped wall 27 of the bowl. The curved lip 28 is disposed adjacent to the top edge 15 of the outer housing 12.

As shown in FIG. 2, a channel 34 extends from the outer surface 24 of the bottom of the bowl 20. The channel 34 is positioned adjacent to the launch assembly 60 when the bowl is placed on the launch assembly 60. The bottom surface of the bowl is mounted to the pulley of the launch assembly 60 by a plurality of fasteners, such as screws. The launch assembly 60 of the present invention will be discussed in greater detail with respect to FIG. 4.

A cylindrical member 40 with a generally cone shaped top portion 42 is positioned near the bottom of the bowl. The cylindrical member 40 is positioned on a circular platform 44. The circular platform 44 includes a notch or groove (not shown) adapted to receive an axle 70 extending from the center of the launch assembly 60 (see FIG. 4). As a result, the circular platform 44 is affixed to the axle 70. The axle 70 defines the center axis of the device. As such, the cylindrical member 40 and circular platform 44 are positioned at the center of the bowl 20.

The circumference of the cylindrical member is smaller than the diameter of the bowl. As a result, when the cylindrical member 40 is positioned inside of the bowl 20, a gap 50 is formed between the outer surface 41 of the cylindrical member 40 and the scalloped lining 23 adjacent to the vertical linear wall 31 of the bowl 20.

The cone shaped top portion 42 of the cylindrical member 40 also includes a plurality of ears 43 extending from the top portion. The ears 43 are spaced an equal distance from each other. The ears flare outwardly towards the inner surface 22 of the bowl 20. The cone shaped top portion 42 may be molded with the cylindrical member 40 or the cone shaped top portion 42 may be formed as a separate piece that is affixed to the top of the cylindrical member 40.

The cylindrical member 40, the cone shaped top portion 42, the ears 43, and the circular platform 44 are molded from a plastic, such as ABS.

Figure 3:
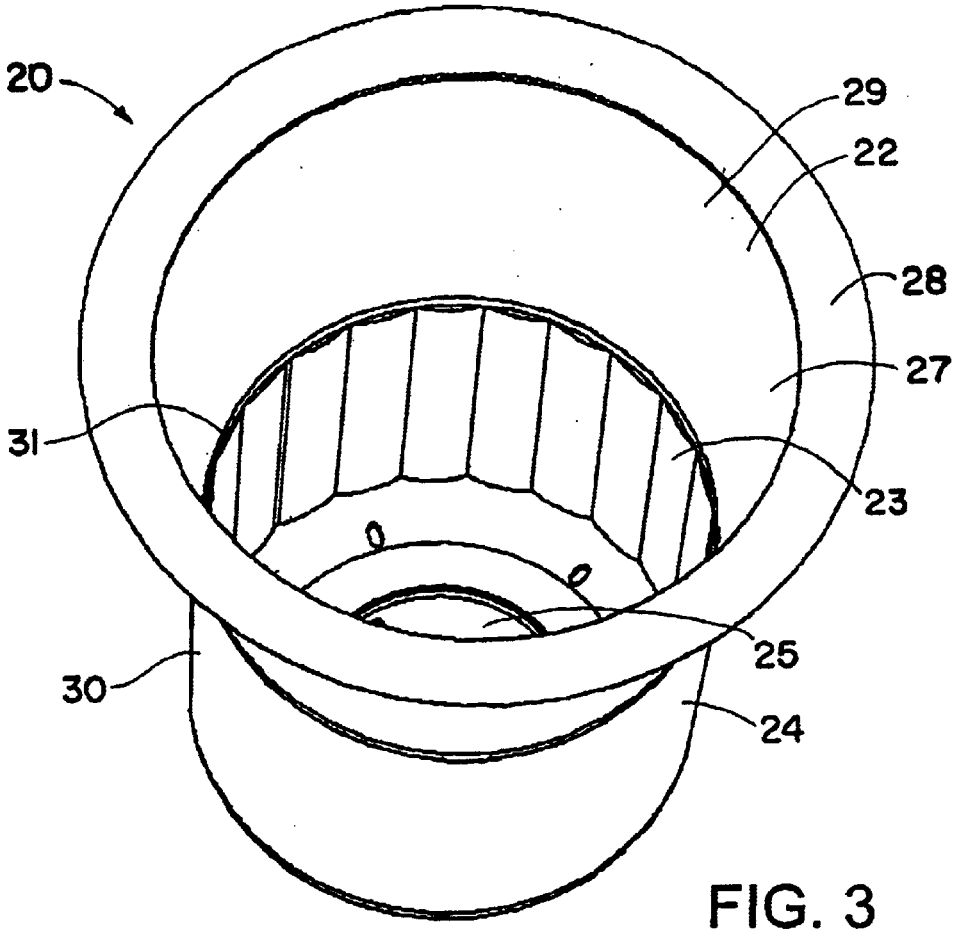
FIG. 3 is a perspective view of the inside of the bowl with a scalloped shaped lining of the ball launching device of FIG. 1.

FIG. 3 illustrates the inner surface 22 of the bowl 20 with the lining 23 preferably having a scalloped shape. Alternatively, the lining may have various curved patterns. The scalloped shaped lining 23 prohibits long cylindrical shaped foreign objects, such as pencils or pens, from ascending up the vertical linear wall of the bottom half of the bowl. As a result, the scalloped shaped lining prevents cylindrical shaped foreign objects from being launched out of the bowl.

FIG. 4 illustrates the launch assembly 60 of the present invention. The launch assembly 60 is enclosed within: the outer housing 12 of the ball launching device. The launch assembly 60 includes a casing 62 that houses a motor 64, a belt 66 and pulley 68. The casing 62 includes a cylindrical opening 63 in the center. The pulley 68 also includes a cylindrical opening 69 through the center of the pulley 68. The pulley 68 is positioned within the casing 62 such that the opening 69 in the pulley 68 aligns with the opening 63 in the casing 62.

The pulley 68 includes a groove 71 formed along the outer rim of the pulley 68. The belt 66 is disposed in the groove 71 along the outer rim such that the belt 66 surrounds the pulley 68. The belt 66 is powered by the motor 64. As a result, when the motor is running, the belt transmits its energy to rotate the pulley 68 thereby also rotating the bowl 20 attached thereto.

The openings 63 and 69 in the casing 62 and the pulley 68, respectively, house an axle 70 and at least one sleeve bearing 72 that is positioned around the axle 70. The axle 70 is fixed to the casing such that when the pulley 68 rotates, the axle 70 remains fixed at the center of the casing 62. The sleeve bearing(s) 72 allow the pulley 68 to rotate about the axle 70 with minimal friction between the axle 70 and the pulley 68.

The casing 62 includes a battery compartment 74 for receiving batteries that provide power to operate the ball launching device. The casing 62 also includes a controller, such as a controller number W528510 by Windbond Electronics Corporation, that is in communication with the on/off button 76, the motor 64 and a speaker 79 (see FIG. 5).

Figure 5:
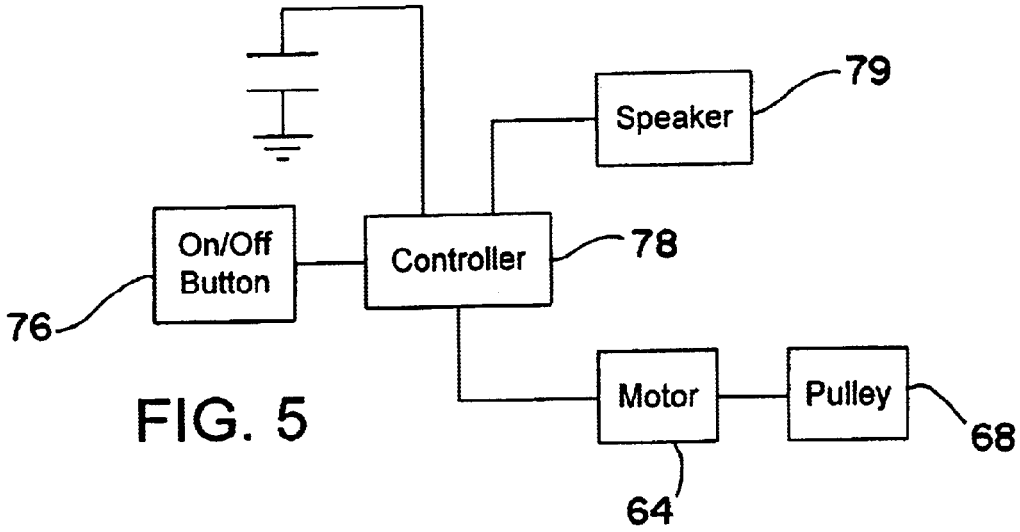
FIG. 5 is a schematic view of the launch assembly of the present invention.

FIG. 5 is a schematic drawing of the launch system of the present invention. The on/off button 76 is in communication with the controller 78. Once activated, the controller 78 sends a signal to the speaker 79 and the motor 64 which rotates the belt 66 thereby rotating the pulley 68 and the bowl of the launching device.

Figure 6:
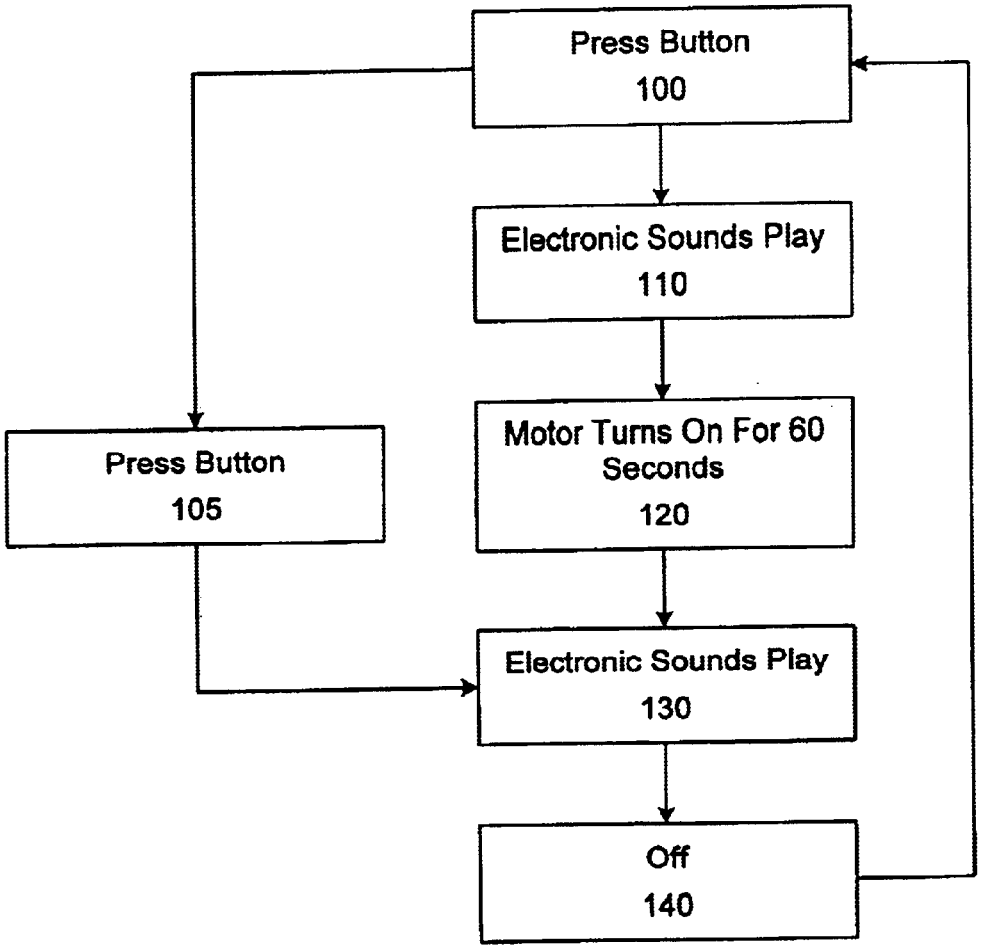
FIG. 6 is a flow diagram of the system of the ball launching device of the present invention.

FIG. 6 is a flow diagram that illustrates the system of the ball launching device. When the user engages the on/off button at 100, electronic sounds will be emitted from the speaker at 110 to signify that the ball launching device has been activated. The motor then runs for 60 seconds as indicated at 120. More specifically, during the first 10 seconds, the motor turns on for 2 seconds and then off for 0.5 seconds for four cycles. During the remaining 50 seconds, the motor is on continuously. After 60 seconds have passed, electronic sounds are again emitted from the speaker at 130, and the ball launching device automatically shuts off at 140.

Alternatively, if the on/off button is pressed twice at 100 and at 105, the ball launching device would emit electronic sounds at 130 to signify that the device is going to shut off. Then, the ball launching device shuts off at 140.

In use, the ball launching activity device of the present invention enables children to develop hand—eye coordination skills while burning energy. As illustrated in FIG. 5, once the on/off button 76 is pressed, the controller 78 activates the motor 64. The controller 78 is programmed to run the motor at least 500 rpm. As the motor begins to run, the belt 66 attached thereto begins to rotate. Since the belt 66 is disposed in a groove 71 around the outer rim of the pulley 68, the belt 66 transmits its energy to the pulley 68 so that the pulley 68 also rotates.

As discussed above, the bowl 20 is attached to the pulley 68 and the cylindrical member 40 located inside the bowl is affixed to the stationary axle 70. As a result, when the pulley 68 rotates, it spins the bowl 20. However, since the cylindrical member 40 is affixed to the stationary axle 70, the cylindrical member 40 remains stationary inside of the bowl 20. The casing 62 of the launch assembly 60 balances the rotating pulley and bowl attached thereto so that the device functions properly. The outer housing 12 of the ball launching device also remains stationary while the bowl 20 positioned therein rotates.

The ball launching device of the present invention launches balls 80 from the upper end 29 of the open bowl 20. The balls 80 are made from a soft durometer plastic, such as EVA. The balls 80 may be placed in the device before it is activated or the balls 80 may be tossed into the bowl 20 while the device has been activated and the bowl 20 is spinning. If the balls 80 are in the device before it is activated, once the bowl 20 begins to rotate, the balls 80 start to bounce or jump around the inside of the bowl 20. The cone shaped top 42 and the ears 43 of the cylindrical member 40 maintain the balls 80 within the top half 26 of the bowl 20. Foreign objects that were laying on top of the balls or between the balls, however, fall between the ears 43 and into the gap 50 between the scalloped lining 23 against the vertical linear wall 31 of the bowl 20 and the cylindrical member 40. As discussed above during the initial 10 seconds of the system of the ball launching device, the motor runs for 2 seconds and then is off for 0.5 seconds for four cycles. This ramp up process also causes the foreign objects to fall into the gap since the contents of the bowl shift each time the bowl starts to rotate after the 0.5 seconds of rest. As a result, the foreign objects that were located in the top half of the bowl are collected and remain trapped on the bottom surface 25 of the bowl 20.

The bottom half 30 of the bowl 20 has steep vertical sides 31 which prevent foreign objects from moving up the scallop lining of the vertical sides of the bowl 20 when the bowl 20 is rotating. Thus, once a foreign object falls below the top half 26 of the bowl 20 into the area of the bottom half 30 of the bowl 20, it becomes trapped on the bottom surface 25 of the bowl 20. The foreign objects remain trapped on the bottom surface 25 of the bowl 20 until the objects are removed by the user, preferably an adult, from the bottom surface 25 of the bowl 20 when the device is shut off.

The balls, however, might temporarily rest in the gap 50 between the inner surface 22 of the bowl 20 and the cylindrical member 40. The cylindrical member 40 is sized to define a gap 50 that is smaller than the diameter of the ball 80 to prevent the balls from falling to the bottom of the bowl. If a ball 80 becomes jammed in the gap 50, however, the bowl 20 will stop rotating.

Once the bowl 20 is rotating at a sufficient speed, such as 500 rpm, the balls 80 disposed within the top half of the bowl ascend or climb up the cone shaped wall 27 of the top half of the bowl 20. As the bowl 20 spins and the balls 80 therein revolve around the central axis defined by the axle 70, a centrifugal force is created on the balls 80 inside the bowl 20. As the balls climb the cone shaped wall 27 and approach the open upper end 29 and the lip 28 of the bowl 20, the balls 80 are spun out of the bowl 20.

The ball launching device of the present invention is capable of launching approximately 1–10 balls at the same time. The device launches the balls such that they land in a 360 degree area around the device. This provides the necessary randomness to maintain the interest of young children thereby entertaining the children playing with the ball launching device.

As discussed above, the device is pre-programmed so that the motor runs for 60 seconds and then shuts off. When the device shuts off, the children playing with the ball launching device are given an opportunity to gather all of the launched balls and place them into the bowl of the launching device in preparation for restarting the device.

While the preferred embodiment of this invention has been shown and described, it will be apparent to those skilled in the art that changes and modifications may be made therein without departing from the spirit of the invention, the scope of which is defined by the appended claims.

What is claimed is:

1. A ball launching device for children, the device comprising:

a bowl having an inner surface and a cone shaped wall which extends outwardly in an upward direction, having an upper end which is opened; and a launch assembly positioned within the ball launching device and coupled to the bowl, the ball launching assembly adapted to rotate the bowl, whereby when the bowl is rotating at a high speed, the cone shaped wall enables a ball to ascend up the inner surface of the bowl and eventually propel out of the device.

2. The ball launching device of claim 1, wherein the bowl has a linear wall that leads to the cone shaped wall.

3. The ball launching device of claim 1, further comprising a cylindrical member with a cone shaped top disposed within the bowl and secured to the launch assembly, wherein the cylindrical member does not rotate with respect to the bowl.

4. The ball launching device of claim 3, wherein the cone shaped top has at least one ear extending outwardly from the cone shaped top.

5. The ball launching device of claim 3, wherein the cylindrical member is positioned at the center of the bowl so as to form a gap between the cylindrical member and the inner surface of the bowl.

6. The ball launching device of claim 1, wherein at least a portion of the inner surface of the bowl has a scalloped lining.

7. The ball launching device of claim 1, wherein the launch assembly has a pulley energized by a motor to rotate the bowl, the launch assembly further includes a casing for housing the pulley and the motor, the casing balances the bowl as it rotates in the device.

8. The ball launching device of claim 1, further comprising an outer housing, the outer housing having a bottom portion with feet to stabilize the device and an outwardly curved top portion.

9. The ball launching device of claim 1, further comprising a means for initial rotation of the bowl that enables foreign objects therein to fall to a bottom surface of the bowl.

10. A ball launching device for children, the device comprising:

a bowl having an inner surface and a cone shaped wall which extends outwardly in an upward direction, having an upper end which is opened;

a launch assembly positioned within the ball launching device and coupled to the bowl, the ball launching assembly adapted to rotate the bowl; and a means for preventing foreign objects from exiting the rotating bowl, whereby when the bowl is rotating at a high speed, the cone shaped wall enables a ball to ascend up the inner surface of the bowl and eventually propel out of the device.

11. The ball launching device of claim 10, wherein the bowl has a linear wall that leads to the cone shaped wall.

12. The ball launching device of claim 10, wherein the means for preventing foreign objects from exiting the rotating bowl includes a cylindrical member with a cone shaped top disposed within the bowl and secured to the launch assembly, wherein the cylindrical member does not rotate with respect to the bowl.

13. The ball launching device of claim 12, wherein the cone shaped top has at least one ear extending outwardly from the cone shaped top.

14. The ball launching device of claim 12, wherein the cylindrical member is positioned at the center of the bowl so as to form a gap between the cylindrical member and the inner surface of the bowl.

15. The ball launching device of claim 10, wherein the means for preventing foreign objects from exiting the rotating bowl includes a scalloped lining along at least a portion of the inner surface of the bowl.

16. The ball launching device of claim 10, wherein the launch assembly has a pulley energized by a motor to rotate the bowl, the launch assembly further includes a casing for housing the pulley and the motor, the casing balances the bowl as it rotates in the device.

17. The ball launching device of claim 10, further comprising an outer housing, the outer housing having a bottom portion with feet to stabilize the device and an outwardly curved top portion.

18. The ball launching device of claim 10, further comprising a means for initial rotation of the bowl that enables foreign objects therein to fall to a bottom surface of the bowl.

19. A ball launching device for children, the device comprising:

an outer housing, the outer housing having a bottom portion and an outwardly curved top portion;

a bowl disposed within the outer housing, the bowl having an inner surface and a cone shaped wall which extends outwardly in an upward direction;

a launch assembly positioned within the outer housing and coupled to the bowl, the launch assembly adapted to rotate the bowl, wherein when the bowl rotates at a high speed, the cone shaped wall enables balls therein to ascend up the inner surface of the bowl and eventually propel out of the device.

20. The ball launching device of claim 19, wherein the bowl has a linear wall that leads to the cone shaped wall.

21. The ball launching device of claim 19, further comprising a cylindrical member with a cone shaped top disposed within the bowl and secured to the launch assembly, wherein the cylindrical member does not rotate with respect to the bowl.

22. The ball launching device of claim 21, wherein the cone shaped top has at least one ear extending outwardly from the cone shaped top.

23. The ball launching device of claim 21, wherein the cylindrical member is positioned at the center of the bowl so as to form a gap between the cylindrical member and the inner surface of the bowl.

24. The ball launching device of claim 19, wherein at least a portion of the inner surface of the bowl has a scalloped lining.

25. The ball launching device of claim 19, wherein the launch assembly has a pulley energized by a motor to rotate the bowl, the launch assembly further includes a casing for housing the pulley and the motor, the casing balances the bowl as it rotates in the device.

26. The ball launching device of claim 19, further comprising a means for initial rotation of the bowl that enables foreign objects therein to fall to a bottom surface of the bowl.

* * * * *